United States Patent [19]

Bosman

[11] 4,269,795

[45] May 26, 1981

[54] PACKING IN WET COOLING TOWERS AND METHOD OF AND MEANS FOR SUPPORTING THE PACKING

[75] Inventor: Peter B. Bosman, Sandton, South Africa

[73] Assignee: WLPU Holdings Limited, Johannesburg, South Africa

[21] Appl. No.: 22,280

[22] Filed: Mar. 20, 1979

[30] Foreign Application Priority Data

Mar. 22, 1978 [ZA] South Africa ..... 78/1679

[51] Int. Cl.[3] ..... B01F 3/04

[52] U.S. Cl. ..... 261/111; 248/340; 261/DIG. 11

[58] Field of Search ..... 261/111, 112, DIG. 11, 261/DIG. 14, DIG. 15, DIG. 72; 248/339, 340; 52/79.2

[56] References Cited

U.S. PATENT DOCUMENTS

| | | | |
|---|---|---|---|
| 507,394 | 10/1893 | Trewhella | 248/339 |
| 2,490,080 | 12/1949 | Melvill | 261/DIG. 11 |
| 2,875,991 | 3/1959 | Ruegsegger | 261/DIG. 15 |
| 2,911,204 | 11/1959 | Malone | 261/DIG. 72 |
| 3,618,778 | 11/1971 | Benton et al. | 261/112 X |
| 3,643,931 | 2/1972 | Henning et al. | 261/111 |
| 3,733,063 | 5/1973 | Loetel et al. | 261/DIG. 11 |
| 3,799,516 | 3/1974 | Furlong et al. | 261/111 |
| 4,133,851 | 1/1979 | Ovard | 261/111 |

FOREIGN PATENT DOCUMENTS

| | | | |
|---|---|---|---|
| 781160 | 8/1957 | United Kingdom | 261/DIG. 11 |

*Primary Examiner*—Richard L. Chiesa

[57] ABSTRACT

The invention provides for a method of and means for supporting the packing in an evaporative cooling tower in which the packing includes packing elements, each of which is suspended at its central region by means of a wire hanger. The packing element includes spaced splash ribs and the elements are vertically arranged offset from each other so that in plan view the packing presents an uninterrupted surface.

20 Claims, 12 Drawing Figures

PACKING IN WET COOLING TOWERS AND METHOD OF AND MEANS FOR SUPPORTING THE PACKING

BACKGROUND TO THE INVENTION

This invention relates to improvements in or relating to cooling towers. The invention relates in particular to a method of and means for supporting the packing in wet cooling towers in which a heated liquid is cooled evaporatively by natural or induced air flow. More specifically, the invention relates to a method of and means for supporting a packing which is of a modular configuration and comprises a plurality of packing elements.

According to the invention there is provided a method of supporting a packing element of a packing of an evaporative cooling tower, the method including the step of suspending the element at a central region of the element.

The packing may be of the splash pack type, which splits and diffuses a spray of heated liquid into smaller droplets and the packing element is adapted to split and diffuse the spray of liquid into smaller droplets.

The splash pack comprises a plurality of splash elements or splash ribs, each having splash surfaces which may consist of a variety of forms such as grids, bars, rods or slats, and may consist of a variety of materials such as synthetic plastics materials or timber.

The method may include suspending the packing element by means of a support formation provided thereon. Still further the method may include suspending the packing element by means of a tensile element in the form of a wire hanger having hooked ends, one of the hooked ends being engageable with the support formation.

The packing element may have an elongate splash member and has a first support formation on one side, and a second support formation on the other side of the splash member, and the packing element is suspended by means of either the first or the second support formation.

Further according to the invention there is provided a method of constructing a packing of an evaporative cooling tower, including suspending packing elements from one another at central regions of the packing elements.

The packing may be of the splash pack type comprising several vertically spaced layers of packing elements.

In order to obtain optimum splitting efficiency, it is desirable that the splash ribs in the packing elements should not be vertically aligned in successive layers in order to ensure that droplets which do not splash on the splash ribs in one layer of elements will fall onto the splash ribs in a lower layer of elements.

Accordingly, the method may include arranging the packing elements in successive layers in the splash pack so that splash members of the packing elements in vertically successive layers are horizontally off-set from each other.

Thus, in plan view, several layers of splash elements will present an unbroken surface without any openings.

Each packing element may have a first support formation on one side of its splash member and a second support formation on the other side of its splash member, and the packing elements in two vertically spaced layers are suspended by means of different support formations such that the splash members in two vertically spaced layers are horizontally off-set from each other.

The first support formations may be adjacent their splash members and the second support formations are spaced a distance from their splash members, and which includes turning the elements through 180 degrees after the second layer and then again suspending the elements at alternative support formations in the central region of the elements in a third and a fourth layer of elements, so that all four layers are horizontally offset from each other.

The second support formations may be spaced from their splash members a distance equal to the thickness of the splash members such that the packing elements in successive layers are horizontally offset from each other by a distance equal to the width of one splash member so that in the four layers the elements will be off-set in the first and the fourth layers by four splash member widths.

Each packing element may have a plurality of splash members all of the same width and separated from each other a distance equal to four times their width.

Each packing element may further have a plurality of spaced-apart splash members with one of the splash members of each element being centrally located, the packing elements being suspended at central regions of the central splash members.

Further according to the invention there is provided a packing element for an evaporative cooling tower, the element having a support formation at a central region of the element by means of which the element can be suspended at the central region of the element.

The packing may be of the splash pack type, which is adapted to split and diffuse a spray of heated liquid into smaller droplets, the packing element having one or more splash member for splitting and diffusing the spray of heated liquid into smaller droplets.

The packing element may be suspendable by means of a tensile element in the form of a wire hanger having hooked ends, one of the hooked ends being engageable with the support formation.

More than one support formation may be included at the central region of the packing element, the support formations being spaced from each other.

The packing element may have a centrally located splash member, a first support formation on one side of the centrally located splash member, and a second support formation on the other side of the centrally located splash member.

The first support formation may be adjacent the centrally located splash member, and the second support formation may be spaced from the centrally located splash member a distance equal to its width.

The packing element may be a panel moulded of a synthetic plastics material.

The panel may be rectangular and may have a surrounding rib and two sets of ribs extending at right angles to each other between the surrounding rib. The two sets of ribs may be diagonally oriented.

By extending diagonally across the packing element, the splash ribs together with the surrounding rib provide a convenient orientation feature for orienting the packing elements during assembly.

Conveniently, one corner of the surrounding rib is made obtuse.

The obtuse corner thereby forms the tail of an arrowhead having its point diagonally opposite the obtuse corner. The arrowhead thus formed provides a convenient means for orienting the packing element.

One set of ribs may be splash ribs, while the other set of ribs may be stiffening ribs for stiffening and locating the splash ribs.

The splash ribs may all have the same width, the spacing between the centres of the splash ribs is four times their width.

The invention also extends to a packing for an evaporative cooling tower of the splash pack type incorporating packing elements in accordance with the invention.

The invention still further extends to a packing for an evaporative cooling tower of the splash pack type including packing elements suspended according to the method of the invention.

Still further the invention extends to an evaporative cooling tower including a packing in accordance with the invention.

The invention still further extends to a tensile element in the form of a wire hanger for suspending a packing element according to the method of the invention or for a packing element in accordance with the invention.

The tensile element may be of stainless steel.

The wire hanger may have a hooked end at each end thereof and the hooked ends may be co-planar.

The invention is now described with reference to the accompanying drawings in which.

Figure 1:
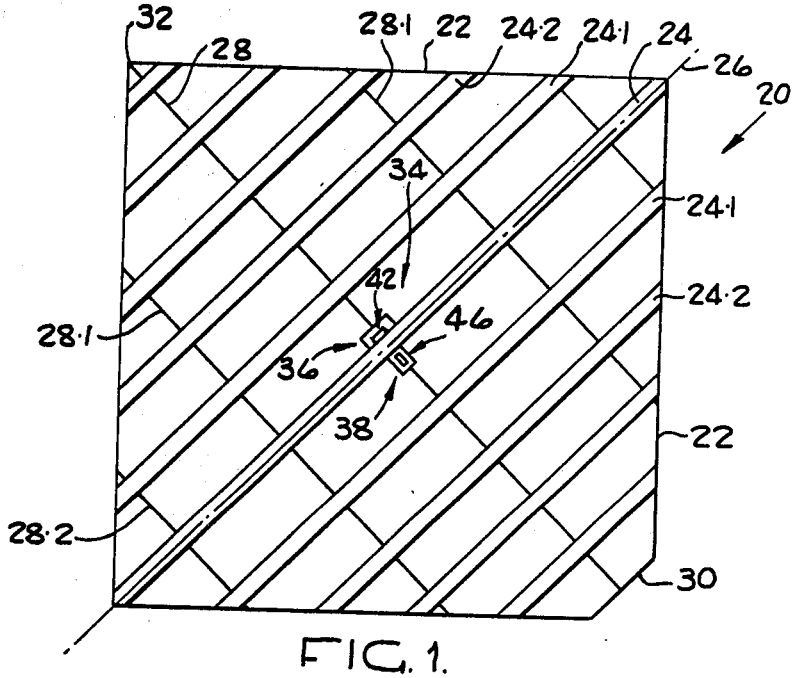
FIG. 1 shows a plan view of a packing element in accordance with the invention.

Referring to FIG. 1, reference numeral 20 indicates in general in plan view a packing element. The packing element can be used side-by-side adjacent similar elements to form a layer of such elements in an evaporative cooling tower (not shown). Furthermore, such a packing can include a plurality of vertically spaced layers of the packing elements 20.

The packing element 20 is moulded in a suitable synthetic plastics material and is of square configuration. It has a surrounding rib 22 and a plurality of splash ribs 24, 24.1, 24.2 etc extending diagonally across the element between the surrounding rib 22. The splash ribs 24, 24.1, etc may have different configurations, and some possible configurations are shown in FIGS. 9 to 12, and will be described later. The central splash rib 24 is symmetrical with respect to the diagonal centre line 26 of the element. The element 20 further includes a plurality of stiffening ribs 28, 28.1, 28.2 etc extending diagonally across the element 20 between the surrounding rib 22 at right angles to the splash ribs 24, 24.1 etc. The ribs 28, 28.1, 22 etc serve only as stiffening ribs for stiffening the splash ribs 24, 24.1 etc and do not serve as splash ribs. They are thus of a small width and consequently offer little resistance to air flow, the cooling efficiency of an evaporative cooling tower being dependent upon air flow through the tower.

One corner 30 of the packing element 20 is obtuse. This provides for the element 20 to form an arrowhead with the corner 32 which is diagonally opposite the obtuse corner 30 forming the point of the arrowhead, and the obtuse corner 30 forming the tail of the arrowhead. This arrangement therefore provides a ready feature for orienting the packing element 20 during assembly of the elements to form a packing.

In the central region 34 of the packing element 20, there are provided two support formations 36 and 38 adjacent the splash rib 24. The element 20 is suspended from either of the support formations 36 and 38 in a manner which will be described below with reference to FIGS. 2 to 7.

Figure 2:
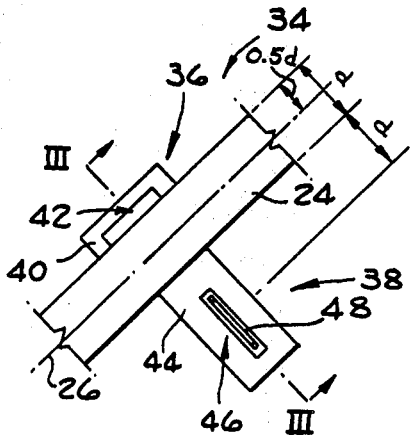
FIG. 2 shows on an enlarged scale a detail of the central region of the packing element shown in FIG. 1.
Figure 3:
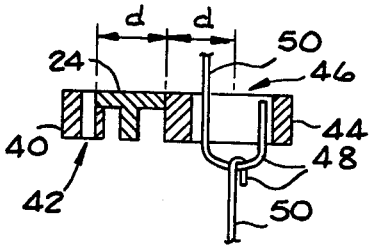
FIG. 3 shows a section on line III—III of FIG. 2.

FIGS. 2 and 3 show on an enlarged scale a detail of the support formations 36 and 38 in the central region 34 of the packing element 20. The support formation 36 comprises a housing 40 fast with the rib 24 and defining an elongate slot 42. The formation 38 includes a housing 44 fast with the rib 24 and defining an elongate slot 46 which is at right angles to the elongate slot 42. As can be seen in the drawings, the width of the rib 24 is a dimension d, the spacing of the elongate slot 42 from the centre line 26 of the rib 24 is 0.5d, and the spacing of the centre of the elongate slot 46 from the centre line 26 is 1.5d.

Figure 7:
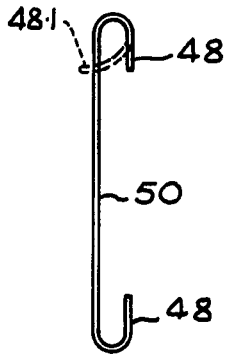
FIG. 7 shows a side view of a wire hanger.

The slots 42 and 46 can receive one of the hooked ends 48 of a wire hanger 50 as shown in FIG. 7. Since the hooks 48 on the wire hanger 50 are co-planar, the hooks in successive wire hangers 50 will be disposed at right angles to each other. It is for this reason that the slots 42 and 46 are at right angles to each other. This will ensure that when packing elements 20 in successive vertical layers are suspended alternatively in the slots 42 and 46, the elements 20 will all be oriented into the same direction as determined by the arrowhead formed by the corner 32 and the obtuse corner 30 shown in FIG. 1.

By way of example, there is shown in FIGS. 2 and 3 a wire hanger 50 with its hooked end 48 seated in the elongate slot 46. The hooked end 48 is interengaged with the hooked end 48 of another wire hanger 50, and the hook 48 is bent over into the position indicated in dotted lines by 48.1 in FIG. 7, to prevent disengagement of the hooked ends. Instead of seating in the elongate slot 46, the hooked end 48 can alternatively seat in the elongate slot 42.

Figure 4:
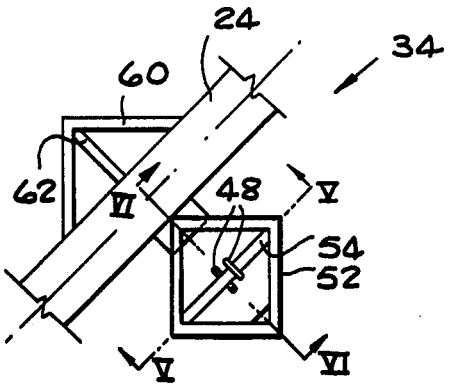
FIG. 4 shows an alternative view, similar to FIG. 2, of an alternative embodiment of the central region of the packing element shown in FIG. 1.
Figure 5:
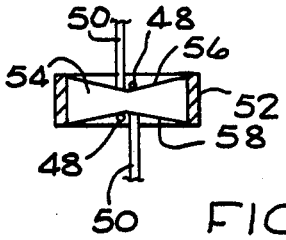
FIG. 5 shows a section on line V—V of FIG. 4.
Figure 6:
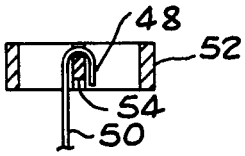
FIG. 6 shows a section on line VI—VI of FIG. 4.

Referring to FIGS. 4 to 6, there is shown an alternative arrangement at the central region 34 of the packing element 20 shown in FIG. 1. This arrangement comprises a square tubular formation 52 fast with the splash rib 24 and having a bar 54 extending diagonally across the formation 52 parallel to the splash rib 24. The bar 54 can support the hooked ends 48 of wire hangers 50 so that in this arrangement the hooked ends 48 will be oriented in the same manner as is effected by the elongate slot 46 shown in FIG. 2. The bar 54 has surfaces 56 and 58 sloping towards the centre of the bar in order to automatically locate the hooked ends 48 at the centre of the bar 54 and therefore in the centre of the tubular formation 52. A triangular formation 60 similar to the formation 52 is provided fast with the splash rib 24 on the other side of the splash rib 24. The formation 60 has a bar 62 extending diagonally across the formation against the splash rib 24. The bar 62 can support the hooked ends 48 of wire hangers 50 in the same manner as the bar 54 in the tubular formation 52. The bar 62 also has top and bottom surfaces, similar to the surfaces 56 and 58 on the bar 54, sloping towards the splash rib 24. Consequently, when hooked ends 48 of wire hangers 50 are hooked onto the bar 60, one of the hooked ends will be adjacent the splash rib 24. The hooked ends 48 engaging the bar 62 will therefore be disposed at right angles to the hooked ends 48 engaging the bar 54, and they will therefore be oriented in the same manner as is effected by the elongate slot 42 as shown in FIG. 2.

In the arrangement shown in FIGS. 4 to 6, the hooked ends 48 engage the bar 54 or the bar 62. The hooked ends 48 do not interengage each other as they do in the arrangement shown in FIGS. 2 and 3.

FIG. 7 shows a wire hanger 50 having hooked ends 48. The hooked ends 48 can be bent over into the position 48.1 when two such hangers are interengaged in order to prevent disengagement of the hooked ends. The wire hanger 50 is conveniently of a corrosion resistant material such as stainless steel.

Figure 9:
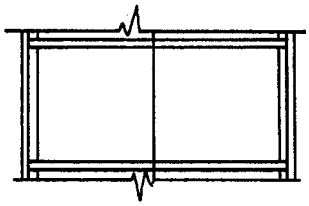
FIG. 9 shows on an enlarged scale a plan view of one configuration of a splash rib included in the packing element shown in FIG. 1.
Figure 10:
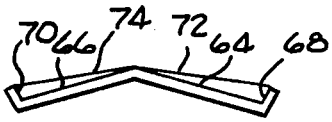
FIG. 10 shows an end view of the splash rib shown in FIG. 9.

FIGS. 9, 10, 11 and 12 show different configurations of the splash ribs 24, 24.1 etc shown in FIG. 1. In FIGS. 9 and 10 the splash rib has a cross-sectional profile of W-shape including two downwardly sloping faces 64 and 66 and two upwardly sloping lips 68 and 70. Droplets falling on the surfaces 64 and 66 flow downwardly along these surfaces and are then deflected upwardly by the lips 68 and 70. Longitudinally spaced barriers 72 and 74 are provided on the surfaces 64 and 66 to further assist in the upward deflection of spray formed by droplets falling on the surfaces 64 and 66.

Figure 11:
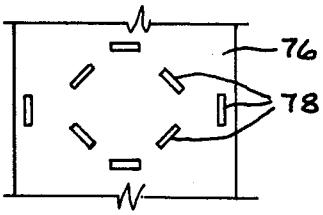
FIG. 11 shows on an enlarged scale a plan view of an alternative configuration of a splash rib included in the packing element shown in FIG. 1.
Figure 12:
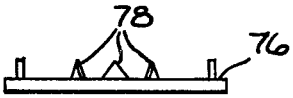
FIG. 12 shows an end view of the splash rib shown in FIG. 11.

FIGS. 11 and 12 show an alternative embodiment of the splash ribs 24, 24.1 etc. In this embodiment the splash rib has a flat surface 76 having a plurality of upwardly directed projections 78. The projections 78 may be of triangular configuration as shown. In this configuration, droplets falling between the projections 78 splash in a horizontal direction across the surface 76 and are split up by the projections 78 to thereby form a spray.

Figure 8:
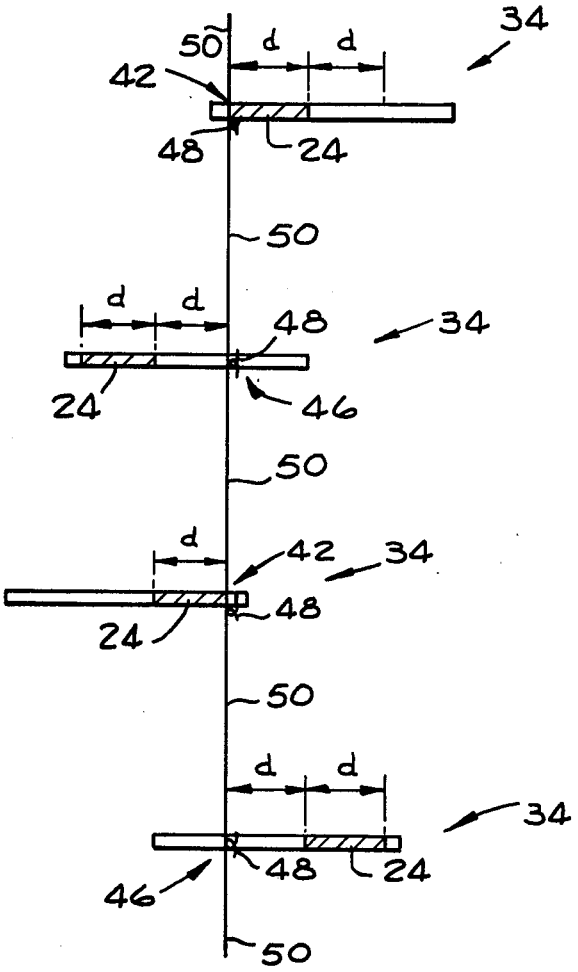
FIG. 8 shows diagrammatically a side view of the central portions of four vertically spaced layers of packing elements.

Referring now to FIG. 8, there is shown diagrammatically a side view of four layers of packing elements 20 suspended from wire hangers 50 by means of the hooks 48 in the manner shown in either FIGS. 2 and 3 or 4, 5 and 6. The drawing only shows the central portion 34 of each element 20 (which is shown in full in FIG. 1) and the remainder of each element 20 is not shown in this figure. For the sake of convenience, reference will be made to the securing formations 42 and 46 shown in FIGS. 2 and 3. The elements 20 are assembled as follows.

The elements are assembled from the top downwardly. In the top layer the central region 34 is secured to the wire hanger 50 by engaging the slot 42. Thus the splash rib 24 is immediately adjacent the wire hanger 50.

The second layer from the top is now assembled by engaging the hooked end 48 of the wire hanger 50 in the slot 46. The effect of this is that the splash rib 24 is positioned a distance d from the wire hanger 50, in other words, the splash rib 24 has moved a distance *2d* towards the left.

In the third layer from the top, the packing element 20 is turned through 180 degrees and the central region 34 is supported by engaging the hooked end 48 in the slot 42. Thereby the splash rib 24 is again immediately adjacent the wire hanger 50, but to the left thereof.

In the lowermost of the four layers the packing element 20 is secured by pointing the element in the same direction as the element in the previous layer and engaging the hooked end 48 of the wire hanger 50 in the slot 46. The effect of this is that the splash rib 24 is positioned a distance d from the wire hanger 50.

The overall effect of the four layers is therefore that, in plan view, none of the splash ribs 24 overlap each other, but instead they are all adjacent each other so that in plan view there is presented an unbroken splash rib surface with a width of *4d*. This is a desirable arrangement as any droplets not intercepted by the higher splash ribs 24 will in their downward travel be intercepted by the lower splash ribs since none of the splash ribs are vertically aligned. Thereby efficient spray forming is ensured.

In order to ensure firmness and stability in each layer which is thus formed from a plurality of horizontally extending packing elements 20 which abut each other, the elements are clipped together along their peripheries by means of clipping arrangements (not shown). The clipping arrangements may be in the form of U-shaped clips engaging the surrounding ribs 22 of each element.

I claim:

1. A method of supporting a packing element of a packing in an evaporative cooling tower, the packing being of the splash pack type which splits and diffuses a spray of heated liquid into smaller droplets and the packing element is adapted to split and diffuse the spray of liquid into smaller droplets, the packing including at least two vertically spaced packing elements having each at least one elongate splash member, the method including suspending each packing element at a central region thereof from a common suspension element so that the packing elements are vertically spaced from each other and so that the splash members are substantially parallel and are horizontally off-set from each other.

2. A method as claimed in claim 1, in which the packing elements are substantially identical and are orientated in the same direction but the horizontal distances between the common suspension element and the splash member of each element are different.

3. A method as claimed in claim 1, in which the packing elements are substantially identical and are orientated in opposite directions by turning one element through 180 degrees so that thereby the horizontal distances between the common suspension element and the splash member of each element are different.

4. A method as claimed in claim 1, in which the packing includes at least three vertically spaced packing elements having each at least one elongate splash member, in which the packing elements are substantially identical and at least two packing elements are orientated in the same direction and at least one packing element is orientated in an opposite direction by being turned through 180 degrees, the horizontal distances between the common suspension elements and the splash members of the packing elements orientated in the same direction being different, and the horizontal distances between the common suspension elements and the splash member of at least one of the packing elements orientated in the same direction and of at least one packing element orientated in an opposite direction being different so that the splash members in vertically adjacent packing elements are horizontally off-set from each other.

5. A method as claimed in claim 1, which includes suspending the packing elements from a common suspension element which is a tensile element in the form of a wire hanger having hooked ends, one of the hooked ends being engageable with either a first or a second support formation on the packing element, the first support formation being on one side of the splash member, and the second support formation being on the other side of the splash member, and the packing element being suspended by the hooked end of the wire hanger engaging either the first or the second support formation.

6. A packing element for an evaporative cooling tower of the splash pack type which is adapted to split and diffuse a spray of heated liquid into smaller droplets, the packing element having at least one splash member for splitting and diffusing the spray of heated liquid into smaller droplets, the packing element having support means by which the packing element is suspended in different positions at a central region of the element so that when at least two such packing elements are suspended in a vertically spaced relationship from a common suspension element, the splash members in the elements are horizontally off-set from each other.

7. A packing element as claimed in claim 6, in which the packing element can be suspended in different positions at the central region by having the orientation of two such elements in the same direction but positioning the elements so that different horizontal distances result between the common suspension element and the splash members.

8. A packing element as claimed in claim 6, in which the packing element can be suspended in different positions by having the orientation of two such elements in opposite directions by turning one element through 180 degrees, thereby effecting different horizontal distances between the common suspension element and the splash members.

9. A packing element according to claim 6, which has a support formation at the central region of the element by means of which the element can be suspended.

10. A packing element as claimed in claim 9, which can be suspended by means of a tensile element in the form of a wire hanger having hooked ends, one of the hooked ends being engageable with the support formation.

11. A packing element as claimed in claim 9, which includes more than one support formation at its central region, the support formations being spaced from each other.

12. A packing element as claimed in claim 11, which has a centrally located splash member, a first support formation on one side of the centrally located splash member, and a second support formation on the other side of the centrally located splash member.

13. A packing element as claimed in claim 12, in which the first support formation is adjacent the centrally located splash member.

14. A packing element as claimed in claim 12, in which the second support formation is spaced from the centrally located splash member a distance equal to its width.

15. A packing element as claimed in claim 9, which is a panel moulded of a synthetic plastics material.

16. A packing element as claimed in claim 15, in which the panel is rectangular and has a surrounding rib and two sets of ribs extending at right angles to each other between the surrounding rib.

17. A packing element as claimed in claim 16, in which the two sets of ribs are diagonally oriented.

18. A packing element as claimed in claim 16, in which one set of ribs are splash ribs, while the other set of ribs are stiffening ribs for stiffening and locating the splash ribs.

19. A packing element as claimed in claim 18, in which the splash ribs all have the same width, the spacing between the centres of the splash ribs is four times their width.

20. A packing element as claimed in claim 16, in which one corner of the surrounding rib is made obtuse.

* * * * *